US005940894A

United States Patent [19]

Cruz

[11] Patent Number: 5,940,894

[45] Date of Patent: Aug. 24, 1999

[54] SANITIZING PROTECTOR FOR DRAINAGE PIPES

[76] Inventor: Luis Cruz, 12511 SW. 9 St., Miami, Fla. 33184

[21] Appl. No.: 09/130,072

[22] Filed: Aug. 7, 1998

[51] Int. Cl.[6] ..... E03D 9/02

[52] U.S. Cl. ..... 4/222; 4/226.1; 4/219

[58] Field of Search ..... 4/222, 226.1, 219, 4/220, 227.1, 227.5, 227.6

[56] References Cited

U.S. PATENT DOCUMENTS 274,466 3/1883 Collings et al. ..... 4/226.1 X

*Primary Examiner*—Henry J. Recla
*Assistant Examiner*—Khoa Huynh

[57] ABSTRACT

A sanitizing protector for drainage pipes typically found below a sink, tub and other plumbing fixtures. The protector includes a housing with two connecting tubular ends. A tubular member is coaxially disposed within the housing and mounted at one end to one of the connecting ends. An annular channel is mounted to the internal surface of the cylindrical wall of the housing and the tubular member passes through without being in contact with it. A dispenser pump supplies an anti-bacterial, and optionally including a fragrance, liquid through a conduit that passes through the cylindrical wall to discharge the liquid in the annular channel. As the liquid reaches the rim of the annular channel, it spills over running downwardly along the internal surfaces of the cylindrical wall and pipe, sanitizing them and preventing any growth to proceed upwardly beyond the annular channel. The tubular ends may include an internal thread or they may be pressure-fitted in series with the drain pipes of the plumbing installation being protected.

5 Claims, 1 Drawing Sheet

SANITIZING PROTECTOR FOR DRAINAGE PIPES

II. BACKGROUND OF THE INVENTION

1. Field of the Invention

The present invention relates to an apparatus containing an antibacterial liquid to be installed to drainage pipes.

2. Description of the Related Art

Applicant believes that the closest reference corresponds to U.S. Pat. No. 274,466 to Collings, et al. (1883) for a sewer inlet. It provides basically a trap b that in FIG. 3 is shown as an annular channel. However, it differs from the present invention because the relative disposition of the components does not prevent the contact of the waste with the channel trough. There is no separation between the channel and the tubular member, and it could not be readily modified to be installed in series with a sink's pipe. Also, bacteria growth may advance through areas on the internal surfaces of the pipes that are not in contact with the antibacterial liquid, if one is to be used. Therefore, even if there are substitutions, the resulting devices would not accomplish the objectives of the present invention.

Other patents describing the closest subject matter provide for a number of more or less complicated features that fail to solve the problem in an efficient and economical way. None of these patents suggest the novel features of the present invention.

III. SUMMARY OF THE INVENTION

It is one of the main objects of the present invention to provide an apparatus that contains an anti-bacterial liquid that prevents the advance of any bacteria or fungus colonies on the inner surfaces of drainage pipes, such as those associated with sinks and bathtubs.

It is another object of this invention to provide an apparatus that includes an anti-bacterial liquid dispenser allowing a user to supply it periodically.

It is still another object of the present invention to provide an apparatus that can be removably mounted below a sink, bathtub, or similar plumbing installation, and in series with the associated connecting drain pipe.

Another object of this invention is to provide a deodorant function by using an anti-bacterial liquid that includes a fragrance.

It is yet another object of this invention to provide such an apparatus that is simple and inexpensive to manufacture, install, and maintain while retaining its effectiveness.

Further objects of the invention will be brought out in the following part of the specification, wherein detailed description is for the purpose of fully disclosing the invention without placing limitations thereon.

IV. BRIEF DESCRIPTION OF THE DRAWINGS

With the above and other related objects in view, the invention consists in the details of construction and combination of parts as will be more fully understood from the following description, when read in conjunction with the accompanying drawings in which.

V. DETAILED DESCRIPTION OF THE PREFERRED EMBODIMENT

Figure 1:
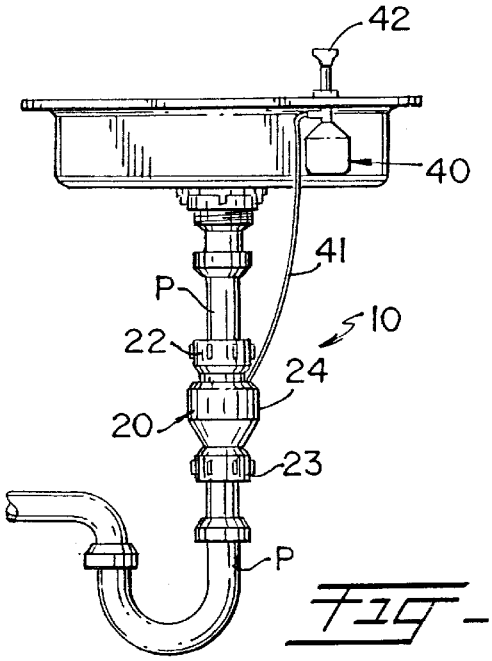
FIG. 1 is an elevational front view of the present invention mounted to a drain pipe typically found below a sink.
Figure 2:
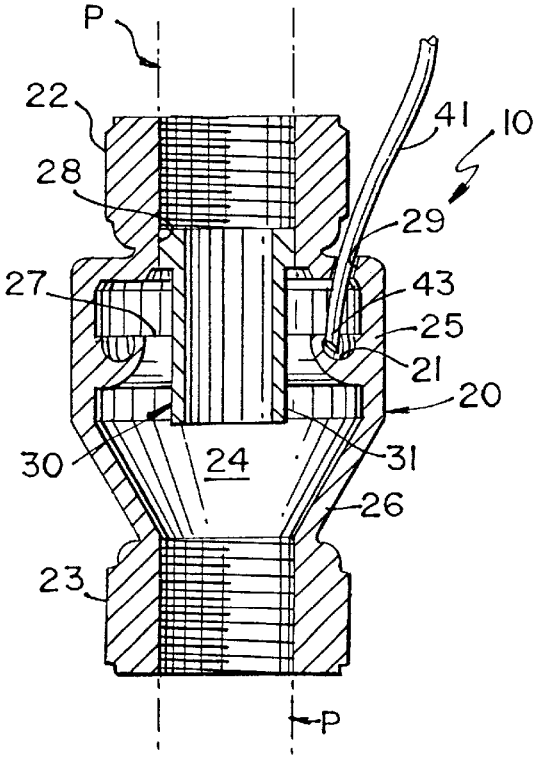
FIG. 2 is an elevational cross section of this invention with a partial view of the feeding hose connected to an anti-bacterial liquid dispenser (not shown).

Referring now to the drawings, where the present invention is generally referred to with numeral 10, it can be observed that it basically includes housing 20 connected in series with drain pipe P and antibacterial liquid dispenser 40 connected to housing 20 with feeding hose 41.

Housing 20, in the preferred embodiment, has upper and lower threaded connecting ends 22 and 23, respectively, and central through chamber 24. Housing 20 is mounted, through ends 22 and 23, to the threaded terminations of drainage pipe P whereto apparatus 10 will be installed. Central through chamber 24, in the preferred embodiment, has a larger diameter than threaded connecting ends 22 and 23. Central through chamber 24 includes cylindrical wall 25 and frustroconical or tapered wall 26 that extends to lower threaded connecting end 23. Central through chamber 24 has annular channel 21 rigidly mounted to the inner surface of cylindrical wall 25. Annular channel 21 is designed to contain an antibacterial liquid supplied through feeding hose 41 connected to anti-bacterial liquid dispenser 40. The anti-bacterial liquid spilling over rim 27 of annular channel 21 travels downwardly by gravity disinfecting the inner surfaces of walls 25 and 26 of housing 20 and pipe P below. The anti-bacterial liquid may include a fragrance thus acting also as a deodorizer. At the very least, any upwardly extending growth of bacteria communities will be stopped by the annular channel 21 containing the antibacterial liquid. The decomposition of organic matter contained in the liquids discharged on the sink, or other similar plumbing installations, typically foster the growth of germ colonies that can be offset with an anti-bacterial liquid. Housing 20 also includes tubular member 30 that is snugly mounted to the lowermost portion of inner surface 28 of end 22. Tubular member 30 has cooperative dimensions to be held in place inside housing 20 and does not come in contact with annular channel 21. Lower end 31 of tubular member 30 extends below annular channel 21. In this manner, the waste liquids and matter do not come in contact with the antibacterial liquid contained in channel 21.

Antibacterial liquid dispenser 40 has feeding hose 41 and pumping actuator 42. Antibacterial liquid dispenser 40 can be mounted to the top of a sink, bathtub or any other selected location. End 43 of feeding hose 41 passes through opening 29 on wall 25, above channel 21, to discharge the anti-bacterial liquid in channel 21.

Figure 3:
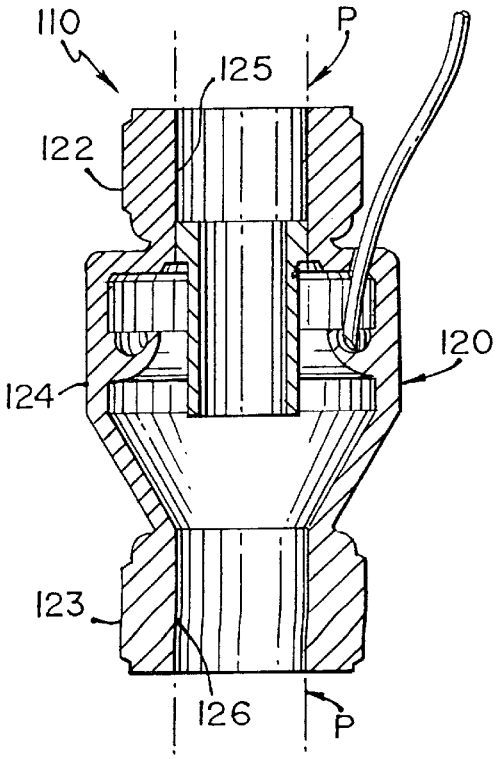
FIG. 3 is an elevational cross section of an alternate embodiment of this invention having a pressure-fit connection instead of a thread.

Similar to apparatus 10, FIG. 3 illustrates alternate embodiment 110 that includes housing 120 having upper and lower connecting ends 122 and 123 and central through chamber 124. Upper and lower connecting ends 122 and 123 are snugly mounted to the un-threaded terminations of a pipe P. In this alternate embodiment, inner surfaces 125 and 126 of connecting ends 122 and 123, respectively, are not threaded and can be readily pressure-fit installed with optional adhesive materials.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A sanitizing protector for a drainage pipe, comprising:

a) a housing having first and second tubular ends connected in series with said drainage pipe, and including a substantially cylindrical wall having a larger diameter than said first and second tubular ends, further including an annular channel mounted to said inner surface, and including a coaxially disposed tubular member, having a through-passage terminating in third and fourth opposite ends, passing through said annular channel, keeping a predetermined separation with respect to said annular channel, and said housing further including an opening through said cylindrical wall above said annular channel, b) means for dispensing a liquid including a conduit that is passed through said opening so that said liquid is selectively discharged on said annular channel; and c) wherein first and second tubular ends include first and second internal cooperative surfaces for connecting to said drainage pipes and said third end of said tubular member is mounted to said first internal cooperative surface, adjacent to said cylindrical wall.

2. The protector set forth in claim 1 wherein said cylindrical wall includes a tapered portion adjacent to said second tubular end.

3. The protector set forth in claim 2 wherein said first and second internal cooperative surfaces include threads.

4. The protector set forth in claim 3 wherein said liquid has antibacterial characteristics.

5. The protector set forth in claim 4 wherein said liquid includes a fragrance.

* * * * *